US009908606B1

(12) United States Patent
Andrasko et al.

(10) Patent No.: US 9,908,606 B1
(45) Date of Patent: Mar. 6, 2018

(54) DRIVE-BY-WIRE CONTROL SYSTEMS AND METHODS FOR STEERING A MARINE VESSEL

(71) Applicant: Brunswick Corporation, Lake Forest, IL (US)

(72) Inventors: Steven J. Andrasko, Oshkosh, WI (US); Kenneth G. Gable, Oshkosh, WI (US); Brad E. Taylor, Dallas, TX (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/190,620

(22) Filed: Jun. 23, 2016

Related U.S. Application Data

(60) Provisional application No. 62/183,381, filed on Jun. 23, 2015.

(51) Int. Cl.
*B63H 25/42* (2006.01)
*B63H 21/21* (2006.01)
*B63H 25/02* (2006.01)

(52) U.S. Cl.
CPC ..... *B63H 25/42* (2013.01); *B63H 21/213* (2013.01); *B63H 25/02* (2013.01); *B63H 2025/022* (2013.01)

(58) Field of Classification Search
CPC .. B63H 2025/022; B63H 25/42; B63H 25/02; B63H 21/213
See application file for complete search history.

(56) References Cited

U.S. PATENT DOCUMENTS

| | | | | |
|---|---|---|---|---|
| 6,273,771 | B1 | 8/2001 | Buckley et al. | |
| 7,104,857 | B1 | 9/2006 | Swan et al. | |
| 7,112,107 | B1 | 9/2006 | Torgerud | |
| 7,305,928 | B2 | 12/2007 | Bradley et al. | |
| 7,422,497 | B1 | 9/2008 | Wyant et al. | |
| 7,727,036 | B1 | 6/2010 | Poorman et al. | |
| 7,941,253 | B1 | 5/2011 | Brant | |
| 7,997,222 | B2 * | 8/2011 | Hiroshima | B63H 21/213 114/144 RE |
| 8,056,497 | B1 * | 11/2011 | Rondeau | B63B 17/02 114/363 |
| 8,113,892 | B1 | 2/2012 | Gable et al. | |
| 2001/0032749 | A1 * | 10/2001 | Thomas | F16F 9/535 180/402 |
| 2005/0050871 | A1 * | 3/2005 | Wuertz | B62D 11/04 56/10.2 R |
| 2006/0240720 | A1 * | 10/2006 | Yamashita | B63H 21/213 440/1 |
| 2007/0257461 | A1 * | 11/2007 | Lutz | B62D 5/005 280/89 |
| 2007/0289837 | A1 * | 12/2007 | Wheals | F16D 37/02 192/84.81 |

(Continued)

*Primary Examiner* — Rodney A Butler
(74) *Attorney, Agent, or Firm* — Andrus Intellectual Property Law, LLP

(57) ABSTRACT

A drive-by-wire control system for steering a propulsion device on a marine vessel includes a steering wheel that is manually rotatable and a steering actuator that causes the propulsion device to steer based upon rotation of the steering wheel. The system further includes a resistance device that applies a resistance force against rotation of the steering wheel, and a controller that controls the resistance device to vary the resistance force based on at least one sensed condition of the system.

18 Claims, 5 Drawing Sheets

(56) References Cited

U.S. PATENT DOCUMENTS

| | | | | |
|---|---|---|---|---|
| 2009/0188226 | A1* | 7/2009 | Carlson | A01D 34/64<br>56/10.2 R |
| 2009/0198414 | A1* | 8/2009 | Mohning | B60K 6/12<br>701/41 |
| 2009/0266658 | A1* | 10/2009 | Lueker, Jr. | B62D 7/228<br>188/267.1 |
| 2012/0232727 | A1* | 9/2012 | Iwata | B63H 21/21<br>701/21 |
| 2014/0343697 | A1* | 11/2014 | Kuipers | B62D 6/008<br>700/85 |

* cited by examiner

DRIVE-BY-WIRE CONTROL SYSTEMS AND METHODS FOR STEERING A MARINE VESSEL

CROSS-REFERENCE TO RELATED APPLICATION

The present application is based on and claims priority to U.S. Provisional Patent Application Ser. No. 62/183,381 filed Jun. 23, 2015, the disclosure of which is incorporated herein by reference.

FIELD

The present disclosure relates to marine vessels and more particularly to drive-by-wire control systems and methods for steering one or more propulsion devices on a marine vessel.

BACKGROUND

The following U.S. Patents are incorporated herein by reference in entirety:

U.S. Pat. No. 8,113,892 discloses a marine propulsion control system that receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

U.S. Pat. No. 7,941,253 discloses a marine propulsion drive-by-wire control system that controls multiple marine engines, each one having one or more PCMs, i.e. propulsion control modules, for controlling engine functions which may include steering or vessel vectoring. A helm has multiple ECUs, electronic control units, for controlling the multiple marine engines. A CAN, controller area network, bus connects the ECUs and PCMs with multiple PCM and ECU buses. The ECU buses are connected through respective isolation circuits isolating the respective ECU bus from spurious signals in another ECU bus.

U.S. Pat. No. 7,727,036 discloses a system and method for controlling movement of a marine vessel. An operator controllable device outputs a signal that is representative of an operator-desired rate of position change of the vessel about or along an axis. A sensor outputs a signal that is representative of a sensed actual rate of position change of the vessel about or along the axis. A rate of position change controller outputs a rate of position change command based upon the difference between the desired rate of position change and the sensed rate of position change. A vessel coordination controller controls movement of the vessel based upon the rate of position change command.

U.S. Pat. No. 7,422,497 discloses a haptic notification system for a marine vessel which alerts the marine vessel operator and passengers even if those individuals are displaced from the helm position. By changing a sensible characteristic of the vessel, the passengers and operator can be haptically notified that one of them should return to the helm in order to determine the condition about which they were notified U.S. Pat. No. 7,305,928 discloses a vessel positioning system that maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,112,107 discloses a haptic throttle control mechanism that includes a vibrating element that is connected in vibration transmitting relation with the control mechanism. The vibrating element can be a motor with an eccentric weight attached to its shaft or a piezo-ceramic component. The vibrating signal can be used to provide information to the operator of the marine vessel relating to the actual operating speed of the engine or, alternatively, it can be used to alert the operator of an alarm condition.

U.S. Pat. No. 7,104,857 discloses a hydraulically assisted steering system that provides a controller which activates a hydraulic pump when a manual throttle selector handle is in either forward or reverse gear selector positions, but deactivates the pump when the handle is in a neutral gear selector position. A controller can also interrogate an ignition key to make sure that it is in an ON position and also respond to the activation of a manual switch which can be used to override the deactivation step of the pump.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A drive-by-wire control system for steering a propulsion device on a marine vessel includes a steering wheel that is manually rotatable and a steering actuator that causes the propulsion device to steer based on rotation of the steering wheel. The system further includes a resistance device that applies a resistance force against rotation of the steering wheel, and a controller that controls the resistance device to vary the resistance force based on at least one sensed condition of the system.

One embodiment of a method of operating a drive-by-wire control system for steering a propulsion device on a marine vessel includes receiving a rotational position of a manually rotatable steering wheel and causing, with a steering actuator, the propulsion device to steer based on the rotational position of the steering wheel. The method further includes controlling a resistance device to vary a resistance force against rotation of the steering wheel based on at least one sensed condition of the system.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Through experience, research, and development, the present inventors have recognized that conventional mechanical and/or hydraulic steering systems for marine vessels advantageously provide direct tactile feedback to the user regarding operating conditions. The tactile feedback is transmitted via hydraulic and/or mechanical linkages between the user input device, the steering system, and the propulsion device(s). Further, the present inventors have recognized that due to a delay in the force implied on the steering system and the perceivable heading change of the marine vessel, most users rely on this tactile feedback instead of their own visual perception of the vessel's heading. Essentially the process is as follows:

User Steers vessel;

Force applied to steering system;

Counterforce on user input device from mechanical forces within the steering system;

Force by user is greater than counterforce and propulsion system changes from previous position;

Stern of vessel begins to move pivoting on the center of gravity or pressure;

The resultant bow levers contra to the stern;

User perceives vessel has changed course; and

Vessel keel is now on a new bearing relative to the bearing prior to the steering input.

The present inventors have further recognized that this type of feedback from mechanical counterforces is not provided by existing drive-by-wire systems, wherein the user input device and steering actuator(s) electronically communicate and thus are not connected by hydraulic or mechanical linkages. The present inventors have recognized that the absence of such feedback in existing drive-by-wire systems causes the user to disadvantageously encounter (A) unintentional over-correcting of steering input during all operating speed ranges, (B) unintentional under-correcting of steering input during all operating speed ranges, (C) dissatisfaction due to a numbness of steering feeling, (D) dissatisfaction due to a quickness of steering feeling, and/or (E) an inability to judge the heading change of the vessel upon steering input.

The present inventors have endeavored to provide systems and methods that overcome these shortcomings of the prior art. More specifically, the present inventors have endeavored to provide systems and methods for delivering feedback, including tactile feedback, regarding operating characteristics of the steering system to the input device of a drive-by-wire system. Through research and development, the present inventors have arrived at the following examples, which include both systems and methods for calculating and providing such feedback based upon direct force feedback and/or pseudo steering force feedback.

Figure 1:
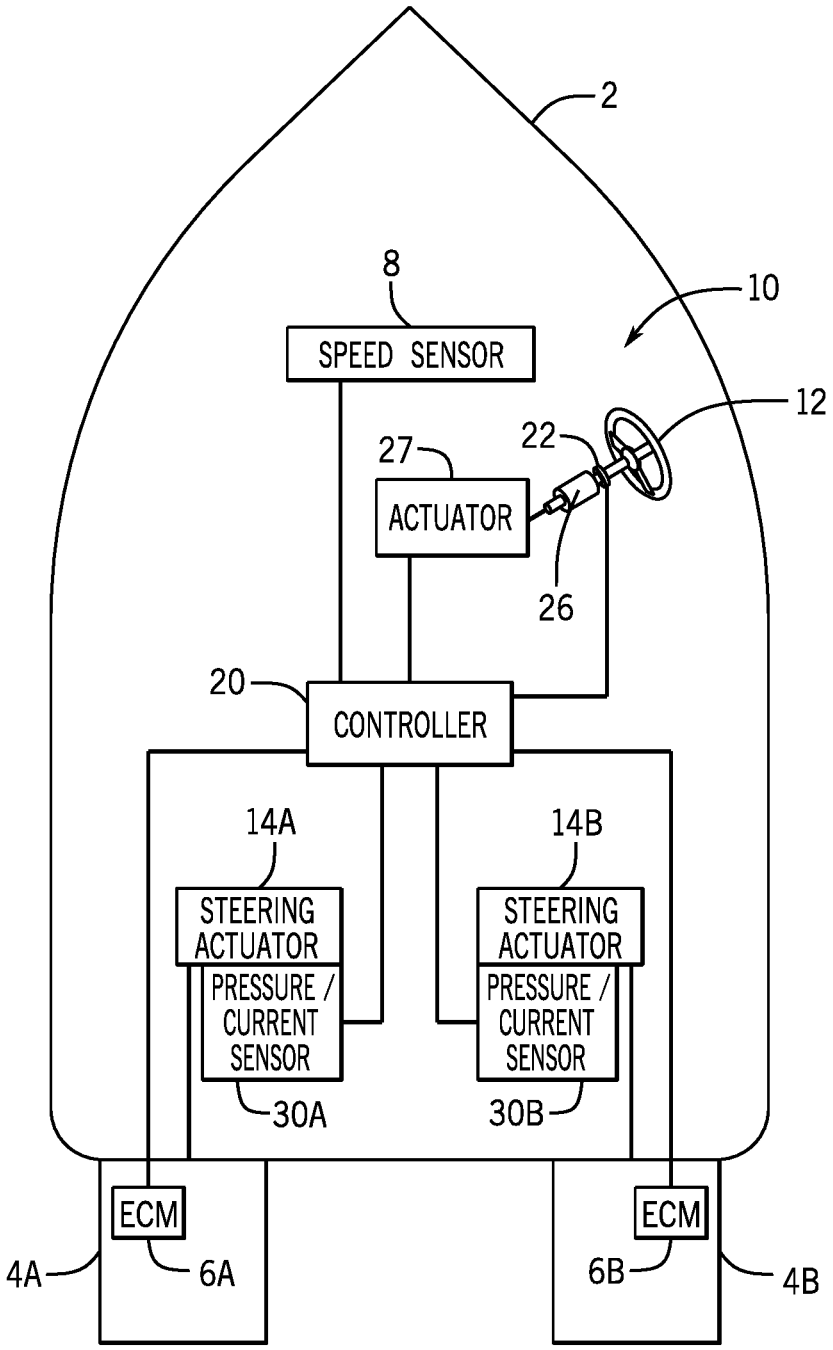
FIG. 1 is a schematic depiction of a control system for a marine vessel.
Figure 2:
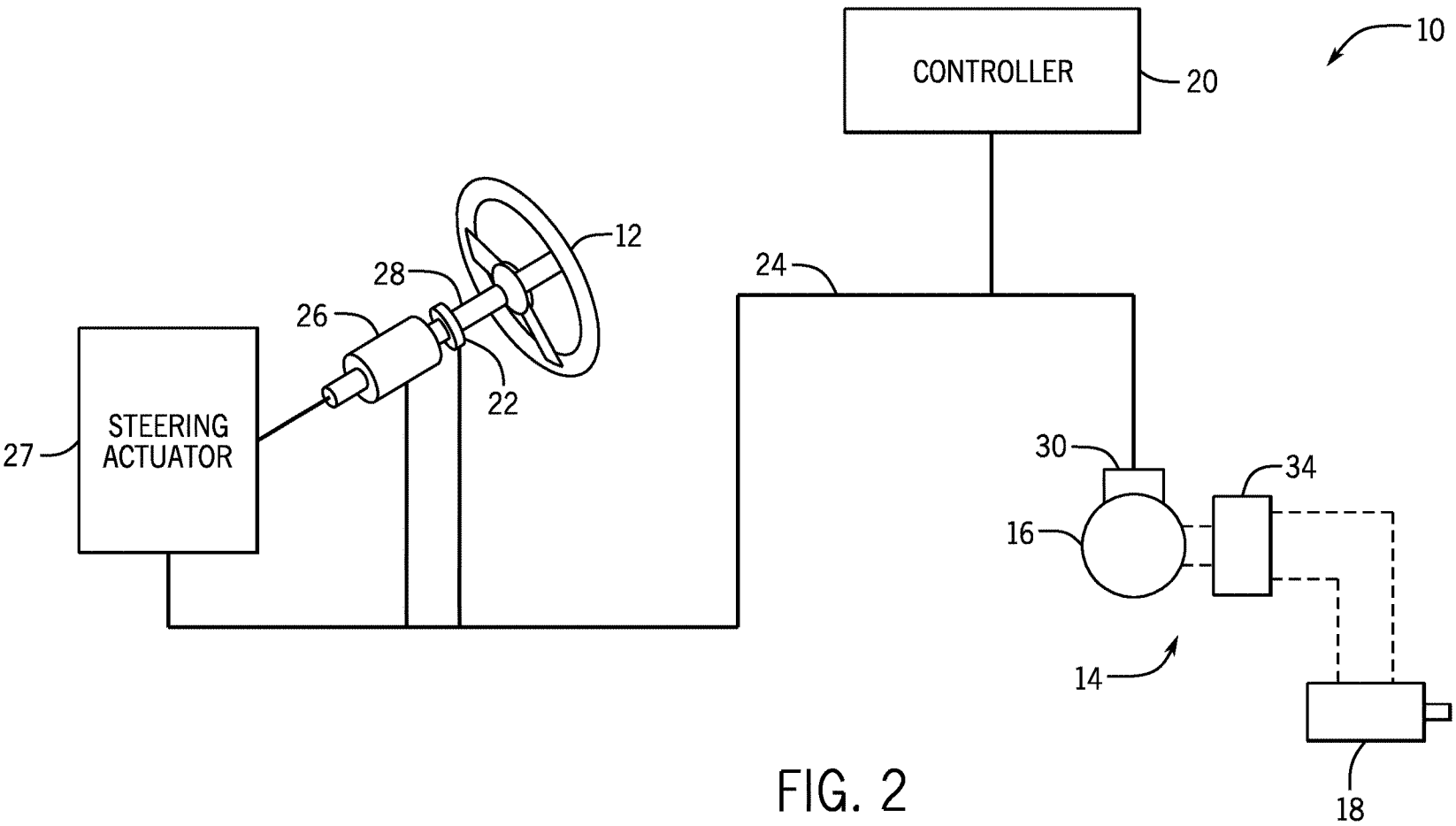
FIG. 2 is a schematic depiction of another embodiment of a control system for a marine vessel.

FIGS. 1 and 2 depict embodiments of a drive-by-wire control system 10 for steering one or more propulsion device(s) 4*a*, 4*b* on a marine vessel 2. The propulsion device(s) 4*a*, 4*b* can be outboard motors, sterndrive systems, or any other type of propulsion device for a marine vessel. Propulsion devices 4*a*, 4*b* may each be associated with an engine control module (ECM) 6*a*, 6*b* providing output signals to control the operation of various components related to the internal combustion engine of the propulsion system used to provide thrust for the marine vessel. While FIG. 1 depicts two propulsion devices 4*a*, 4*b*, the system 10 may incorporate any number of one or more propulsion devices. The system 10 includes, among other things, a manually rotatable steering wheel 12 connected to a steering column 28, and a steering actuator 14*a*, 14*b* associated with each propulsion device 4*a*, 4*b* that causes the respective propulsion device 4*a*, 4*b* to steer about its own steering axis based upon rotation of the steering wheel 12 and steering column 28. In the example of FIG. 2, the steering actuator 14 includes a hydraulic pump 16 that pumps pressurized hydraulic fluid through control valve 34 to either side of a piston-cylinder 18 to thereby control movement of the propulsion device about its steering axis, as further described in U.S. Pat. No. 6,273,771 incorporated herein. A pressure sensor 30, such as a transducer or any other type of pressure sensor, senses pressure associated with the steering actuator 14, such as the hydraulic fluid pressure seen by the hydraulic pump. The type of steering actuator 14 can vary from that which is shown, and in other embodiments may include an electric over hydraulic system or an electric steering actuation system. In such electric embodiments, the hydraulic pump 16 is replaced by an electric pump and pressure sensor 30 may be replaced by a current sensor to determine a current draw of the electric pump.

The system 10 also includes a controller 20 which, as described in the '771 patent, is configured to control the one or more steering actuators 14 based upon the rotational position of the steering wheel 12. The rotational position of the steering wheel 12 is sensed by a conventional position sensor 22, such as an encoder or transducer or other type of position sensor, and communicated to the controller 20 via a serial CAN bus 24. Based upon the position of the steering wheel 12, the controller 20 is programmed to control the steering actuator 14 via the serial CAN bus 24. This type of arrangement is commonly referred to in the art as a "drive-by-wire" system, wherein there is no direct mechanical connection between the steering wheel 12, controller 20, and steering actuator 14.

As described in the '771 patent, the controller 20 includes a memory, a processor (such as a microprocessor or logic device), and programmable input/output peripherals. The processor can be communicatively connected to a computer readable medium that includes a volatile and/or nonvolatile memory upon which computer readable code, or software instructions, is stored. The processor can access the computer readable code and the computer readable medium upon executing the code carries out functions as described herein. Moreover, implementations of controller 20 may comprise one or more processors or memory sets, which may be communicatively connected and cooperate in order to carry out the functions described herein, and such implementations are considered to be within the scope of the description.

The controller 20 is operatively connected to the various elements of the propulsion and steering control system 1. Examples of these elements are provided in U.S. Pat. No. 6,273,771 and incorporated herein. The controller 20 can receive inputs and send outputs via a CAN bus 24, as described in U.S. Pat. No. 6,273,771. In some examples, the controller 20 can be connected to various portions of the system 10, as well as other devices on the marine vessel, via wireless communication rather than by a wired CAN bus. As exemplified in FIG. 1, the controller 20 may be operatively connected to speed sensor 8 that measures a speed of travel of the marine vessel. The speed sensor 8 may be any device capable of measuring or determining the speed of the marine vessel 2, and in exemplary embodiments may include a pitot tube, a paddle wheel, or a global positioning system (GPS)-based speed determination system. Alternatively or additionally, the controller 20 may utilize engine speed of the one or more propulsions devices 4*a*, 4*b* as input for controlling the drive-by-wire steering system, which may be determined and provided by the ECM 6*a*, 6*b* associated with each propulsion device 4*a*, 4*b*.

According to the present disclosure, the controller 20 is uniquely configured to control a resistance device 26, which is operable to apply a resistance force to resist rotation of the steering wheel 12, such as by applying the resistance force to the steering column 28. The type of resistance device 26 can vary and can include any type of electrical, mechanical and/or hydraulic device that is operable to variably resist (i.e. restrict and/or brake) rotational movement of the steering wheel 12 and steering column 28 based upon commands from the controller 20. For example the resistance device 26 can include an electric motor and/or a hydraulic pump that powers a mechanical clamp or other similar device that engages with the steering column 28 of the steering wheel 12 and applies variable resistance force on the steering column 28 to restrict, resist, or brake its rotation. This is just one example and the type of resistance device 26 can vary. In other examples, the resistance device 26 may include 1) a DC motor directly coupled to the steering column 28 capable of braking via short circuit and/or back-driving via H-bridge, 2) a hydraulic circuit with pump directly attached to the steering wheel and a controlled orifice to restrict rotational movement of the steering column 28, 3) a clutch brake mechanism attached to the steering column 28 with a braking force applied to the clutch via a controlled solenoid, 4) a magneto-rheological fluid (MRF) braking mechanism attached to steering column and capable of applying a variable braking force thereon. As further described herein below, the controller 20 can control the resistance device 26 to variably resist rotation of the steering wheel 12 based upon one or more sensed conditions of the system 10. The type of sensed condition(s) of the system can vary and several examples are provided herein.

In certain examples, the controller 20 is programmed to control the resistance device 26 based on steering wheel position and/or motion of the steering wheel 12. More particularly, the resistance device 26 may be controlled based on the position of the steering wheel 12 measured by position sensor 22, and such position measurements may be tracked over time to determine rotational velocity and/or rotational acceleration of the steering wheel 12 (such as by sensing the position of steering column 28). Moreover, the controller 20 may further account for a speed of travel of the marine vessel 2, which may be provided by speed sensor 8, and/or engine RPM in conjunction with a rotational position of the steering wheel 12. Controlling resistance force in this way has been found by the present inventors to advantageously simulate inertia of a mechanical or hydraulic steering system.

In one embodiment, the sensor 22 senses the rotational position of the steering wheel 12. Based upon the rotational positions sensed over time, the controller 20 is programmed to calculate (e.g., by known differential equation) a rotational velocity of the steering wheel 12, and may further determine a rotational acceleration of the steering wheel 12, such as by calculating a second derivative of the rotational position measurements. The memory of the controller 20 may be uniquely programmed with a lookup table that correlates the position, rotational velocity, and/or rotational acceleration of the steering wheel 12 to an amount of resistance force to be provided on the steering wheel 12 by the resistance device 26. For example, the controller 20 may be configured to access one or more such lookup tables to determine an amount of resistance force to be provided on the steering wheel 12 and then control the resistance device 26 accordingly.

Figure 3:
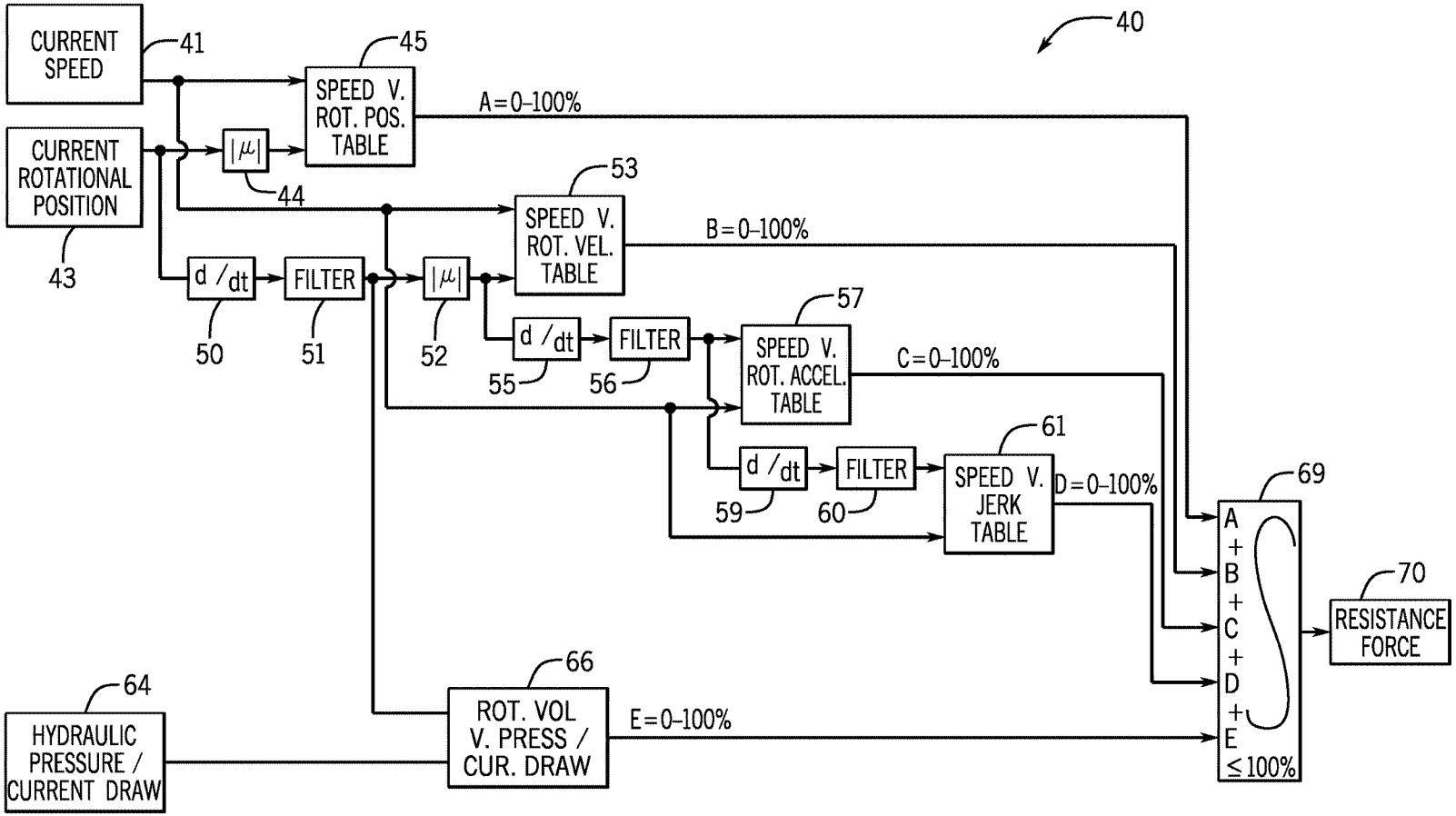
FIG. 3 is a flowchart depicting one embodiment of a method of controlling steering of a propulsion device on a marine vessel.
Figure 4:
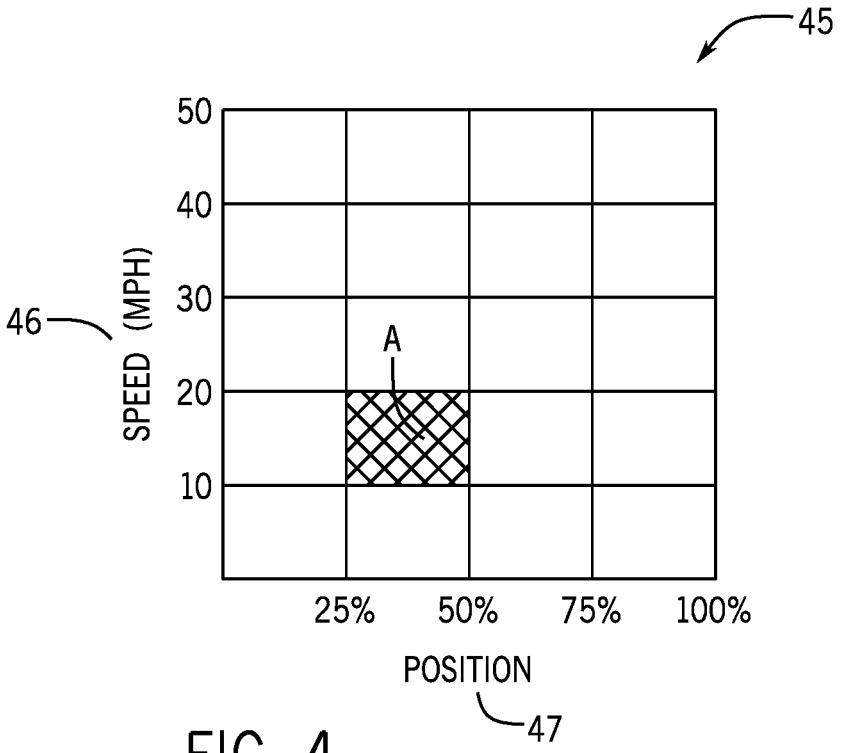
FIG. 4 depicts an exemplary lookup table for a control system and method for controlling steering of a propulsion device on a marine vessel.

FIG. 3 exemplifies such a method 40 of operating a drive-by-wire control system 1 to apply a resistance force to resist rotation of the steering wheel 12. A current speed of travel is received at step 41 and current rotational position is received at step 43. The current speed of travel and rotational position values are utilized to determine a resistance force amount A. For example, the resistance force amount A may be a percentage value between 0%, representing zero resistance force, and 100%, representing a maximum resistance force applicable by the resistance device 26. In other embodiments, the resistance force amount may be an actual force value, or may be another value that correlates with the resistance force amount value (such as current to a steering actuator motor, or the like). In the depicted example, the current speed of travel and rotational position values are correlated with a resistance force amount in a lookup table 45. FIG. 4 depicts one exemplary lookup table 45 comparing a range of speeds of travel in miles per hour (MPH) along the vertical axis 46 and rotational positions along the horizontal axis 47 to resistance force amounts A in each cell. The exemplary lookup table 45 has five rows on the speed axis 46 providing five speed increments, or break points, for correlation with the resistance force amount A in each cell. In the depicted embodiment, the speed break points are in increments of ten miles per hour; however, various other increments may be appropriate depending on the application. Any number of cells, or break points, along the vertical speed axis 46 are likewise contemplated. The horizontal rotational position axis 47 is divided into four cells, or break points, represented by percentage of possible rotational positions achievable by the steering wheel between a 0% centered position (i.e., associated with a straight ahead steering instruction inline with a center axis of the marine vessel 2), and a 100% position (i.e., associated with the maximum rotational position of the steering wheel 12 in either direction). In various embodiments, the rotational position axis 47 may be divided or allocated differently, such as according to degrees of rotation instead of percentages. In the present table, the rotational position percentages are presented as absolute values, and thus the lookup table 45 correlates the same resistance amount values with equivalent rotational positions in both the clockwise and counterclockwise rotational directions. Accordingly, the resistance force amount A is determined as the value in the cell of the lookup table 45 that correlates with the current speed of travel received at step 41 and the absolute value of current rotational position determined at step 44.

In certain examples the controller 20 is programmed to calculate one or more of the rotational velocity, rotational acceleration, and jerk, and access additional lookup tables 53, 57, and 61 to determine a resistance force amount B, C, D, respectively, based on those values. In various embodiments, the resistance force amount values A, B, C, D may then be summed together to determine a final resistance force 70 to be applied on the steering wheel 12 by the resistance device 26.

Steps 50-52 exhibit processing steps, or software instruction modules, that may be executed by the controller 20 to determine the rotational velocity value for use in conjunction with the speed versus rotational velocity lookup table 53. More specifically, the derivative or change between the current rotational position value received at step 43 and one or more previous rotational position values is calculated at step 50, such as based on a predefined number of previously received rotational position values. The derivative output value is filtered at step 51, which may be a first order filter with a time-based filter constant. The absolute value of the output of the filter is determined at step 52, meaning that the resistance force amounts determined by the lookup table 53 will be applied equally in both the clockwise and counterclockwise rotational directions of the steering wheel 12. The output of step 52 and the current speed value received at step 41 are then used to access the speed versus rotational velocity lookup table 53 to determine a resistance force amount B. The speed versus rotational velocity lookup table 53 may be similar to the speed versus rotational position lookup table 45 exemplified at FIG. 4, except that the rotational position axis 47 would be replaced with rotational velocity values (position/time). The speed versus rotational velocity lookup table 53 contains resistance force amounts in each cell, one of which is selected as resistance force amount B.

Similarly, the controller 20 may execute instructions that determine the resistance force 70 based, at least in part, on the rotational acceleration of the steering wheel 12. At step 55, instructions are executed to determine the rate of change, or derivative, of the absolute value of the rotational velocity value determined at step 52 and one or more previously-determined rotational velocity values from the most recent one or more method cycles. A filter may be applied at step 56, such as a first order low pass filter, and the filtered value may be used to access the speed versus rotational acceleration lookup table 57. The speed versus rotational acceleration lookup table 57 is similar to the lookup table 45 described above, except that the rotational position axis 47 is replaced by rotational acceleration values. Further, no absolute value of the acceleration is taken, and thus the rotational acceleration axis of the lookup table 57 may contain both negative acceleration values and positive acceleration values. Larger resistance force amounts may be correlated with positive rotational acceleration values than with negative rotational acceleration values because additional resistance force may not be necessary where the steering wheel is already decelerating. For example, the lookup table 57 may correlate a 0 value to negative rotational acceleration values. This may be the case especially where the lookup table 57 is calibrated to work in conjunction with the lookup tables 45 and 53, and thus is calibrated to only supply a resistance force amount C that is an additive value on to the resistance force amounts A and B from lookup tables 45 and 53. Similar to the above-described lookup tables, the speed versus rotational acceleration lookup table 57 contains resistance force amount values C assigned for each cell, which may be value between 0% and 100% of the maximum available resistance force, as is described above with respect to lookup table 45.

As represented at step 59,the controller 20 may also execute instructions to determine jerk, the change of the rotational acceleration, filter the jerk value at step 60, and utilize a speed versus jerk lookup table 61 to determine a resistance force amount D between 0% and 100%. In certain embodiments, the lookup table 61 is calibrated to provide a resistance force amount D that is an additive value to those provided in lookup tables 45, 53, and 57, and the us the resistance force amount D in lookup table 61 may be smaller than those in the other lookup tables 45, 53, 57. Inclusion of the jerk calculations may add an additional resistance force to mimic the jerk mechanical resistance feel that would naturally be imparted on a steering wheel of a mechanical steering system when the user quickly rotates (i.e. jerks) the steering wheel.

In these examples, the lookup table values are a function of speed of travel of the marine vessel, which has been found to advantageously allow for easier steering around docks and at low speed and has been found to give the system 10 a more natural, mechanical feel. However, in other embodiments, speed of travel may be eliminated as a variable to one or more of the lookup tables 45, 53, 57, 61, which would then be a single row table with one resistance force amount value correlated with each position, velocity, acceleration, or jerk break point.

In various embodiments, any one or more of the variables shown in FIG. 3 may be turned off, or removed from the resistance force calculation by zeroing out the values in the respective lookup tables 45, 53, 57, 61, 66. Each of the resistance force amounts are A-D added together at the summation block 69, which has a saturation value of 100% of the available resistance force amount from the resistance device 26. Accordingly, the summation block 69 will output resistance force 70 that is less than or equal to 100% of the available resistance force from the resistance device 26. If resistance force amounts A-D add to more than 100% of the available resistance force, then the summation block 69 will output 100% or a resistance force 70 equal to the maximum available resistance force.

The controller 20 may also be configured to execute instructions that determine a resistance force amount E based on a hydraulic pressure or electric current draw associated with the one or more steering actuators 14*a*, 14*b*. As described above, each steering actuator 14*a*, 14*b* may be associated with a sensor 30*a*, 30*b*, which may be a hydraulic pressure sensor or a current sensor depending on the system configuration, and which indicates a steering load on the respective steering actuator 14*a*, 14*b*. The measured hydraulic pressure or current draw may be supplied at step 64, and used in conjunction with a lookup table correlating rotational velocity and either the hydraulic pressure or current draw values to resistance force amounts. Thus, the rotational velocity calculated at steps 50 and 51 and the hydraulic pressure or current draw are compared to lookup table 66 to determine an appropriate resistance force amount E to be provided on the steering wheel 12 by the resistance device 26.

The controller 20 is thus programmed to use feedback regarding load one the steering actuator 14 to make steering nominally more resistive based on sensed hydraulic pressure(s) or current draw. This logic can be implemented as a fifth input to the summation block shown in FIG. 3 and would have a similar calibratable lookup table having resistance values that are based on system pressure. Alternatively, the rotational velocity versus hydraulic pressure or current draw may be utilized instead of the lookup tables 53, 57, and 61. In still other embodiments, controller 20 may determine the resistance force 70 based solely on the rotational velocity and the current load on the steering actuators 14*a*, 14*b*. In such an embodiment, the resistance force amount E values in the rotational velocity versus hydraulic pressure or current draw lookup table 66 may be calibrated to provide the full resistance force 70 and thus may be larger than in embodiments where the lookup table 66 is used in conjunction with other lookup tables 45, 53, 57, or 61.

In general, each of these features is independently calibratable to variously turn on and off variables through calibration, as implemented, to thereby allow the feel to be tuned appropriately for different operating conditions. Further, each lookup table 45, 53, 57, 61, and 66 may be calibrated to account for the other tables implemented in the determination method 40 and the position or order of the respective table in execution of the method 40.

The hydraulic pressure or current draw values provided at step 64 may be a net hydraulic pressure or current draw calculated as a sum of the hydraulic pressures or current draws measured by the respective sensors 30*a*, 30*b*. In other embodiments, the hydraulic pressure or current draw values provided at step 64 may be an average or maximum of the hydraulic pressures or current draws measured by the respective sensors 30*a*, 30*b*. The lookup table 66 would be further calibrated accordingly.

This pressure input may also be used by the controller 20 to make feedback directionally more resistant to movement. For example, if the pressure feedback from hydraulic pumps 16 associated with multiple propulsion devices indicates a net force being applied in one direction on the steering wheel 12, e.g. during a turn, the controller 20 can be programmed to apply an appropriate directional resistance. Turning in the direction of the increased pressure can result in higher resistance. If the operator turns the steering wheel 12 away from the high pressure, the resistance force can be decreased or eliminated completely.

In certain examples, the system 10 includes a steering wheel actuator 27 that is capable of causing rotation of the steering wheel 12 from a stationary position. The steering wheel actuator 27 can be the same as or a different device than the resistance device 26. The steering wheel actuator 27 can include, for example, a motor, a pump, and/or the like. In these examples, the controller 20 is programmed to control the steering wheel actuator 27 to provide a force on the steering wheel 12 that requires the user to physically hold the steering wheel 12 in the desired position. For example, the memory of the controller 20 may contain a lookup table similar to those described above that correlates a sensed or calculated characteristic of the system 10, such as pressure associated with the steering actuator 14, to an output of the steering wheel actuator 27. Further, such a lookup table may additionally correlate the rotational position of the steering wheel to an output of the steering wheel actuator 27. Such a table would be similar in format to those described above, except that the values in the cells of the lookup table are associated with actuation of rotational force on the steering column 28 to actively drive the steering wheel 12 back towards a center position, rather than just a resistance force. Based upon the sensed characteristic, the controller 20 can be programmed to control the steering wheel actuator 27 to impart a rotational force on the steering wheel 12 toward the direction of the center straight ahead, or zero, position. This would act similar to the effect that caster provides in a car, driving the steering wheel 12 back to its zero position. Accordingly, this example could provide feedback in the case where there is an observed net steering force from net pressure.

In certain examples, the controller 20 is programmed to control the resistance device 26 or steering wheel actuator 27 to provide the resistance force and thus the steering feedback based on a fault condition, thus serving to alert an operator of the fault condition. For example, when a fault condition is detected by a sensor within the control system 10, the controller 20 may execute instructions to enact a fault action, such as to pulse the resistance device 26 or steering wheel actuator 27 on the steering wheel 12 while it is being moved. In some examples, the steering wheel actuator 27 is capable of imparting a shaking force on the steering wheel 12, actually imparting a vibration into the wheel that will be felt by the operator. In embodiments only including a resistance device 26, the resistance force may be pulsed so that that as the operator will feel a pulsing as they turn the steering wheel 12. Examples of such a device are provided in the incorporated U.S. Pat. No. 7,112,107. In this example, the controller 20 can cause the steering wheel actuator 27 to shake the steering wheel 12 to give immediate feedback, with or without the operator physically moving the steering wheel 12.

In certain examples, the controller 20 is programmed to control the resistance device 26 based upon the rotational position, rotational velocity and/or rotational acceleration of the steering wheel 12 relative to the end stops of the steering wheel 12 to ensure that an endstop is applied at the appropriate time. Through their experimentation and research in the relevant field, the inventors have recognized that due to mechanical delay times between sending the braking instruction and the resistance device 26 actually effectuating the instruction, in drive-by-wire steering systems only having resistance devices 26 to implement endstops the controller 20 may need to anticipate when the endstop will be reached and send instruction to the resistance device 26 to apply the braking resistance force slightly ahead of the steering wheel 12 actually reaching the endstop. Likewise, the inventors recognized that available end stop braking systems are insufficient for effectuating consistent endstops because they only apply braking force as a function of absolute wheel position, for instance, and only begin applying end stop force at 98%, more at 99%, and full braking, or maximum resistance force, at 100% steering wheel position. Due to the mechanical delays in the system, the braking is often applied too late and thus the steering wheel 12 is permitted to move past the endstop.

The intent here is to have additional pre-control terms based on wheel velocity and acceleration rates. In these examples, the memory of the controller 20 stores the end stops (i.e. rotational limits/stopping points) of the steering wheel 12. The controller 20 is programmed such that if the steering wheel 12 is steered quickly toward the end stop, the controller 20 is programmed to predict when the end stop will be reached and then control the resistance device 26 to resist rotation, at a calculated location before the end stop.

The estimation calculated by the controller 20 can be a function of the current position trajectory of the steering wheel 12 (e.g., based on the velocity and/or acceleration of the steering wheel 12) as well as the physical response time of the resistance device 26.

Figure 5:
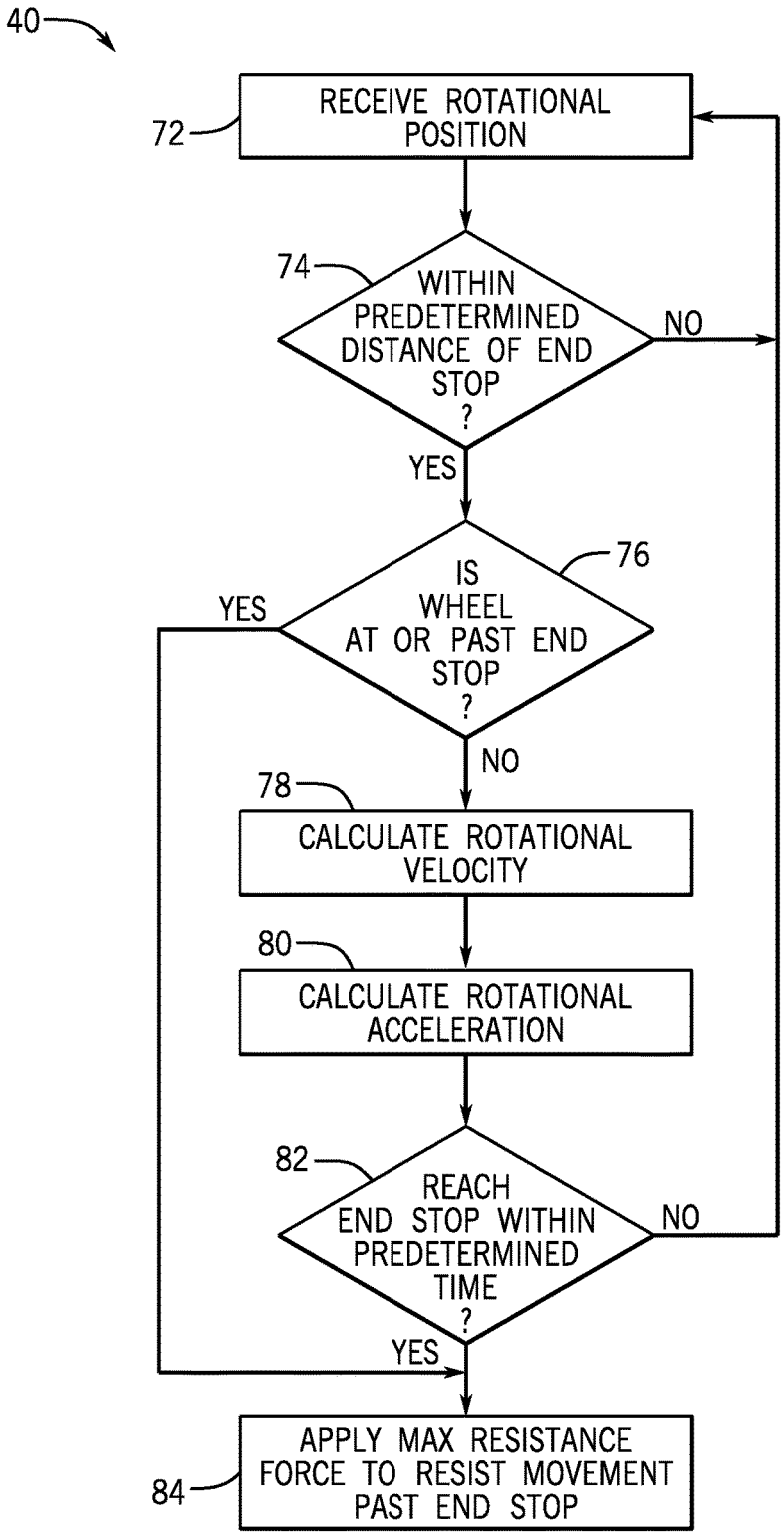
FIG. 5 is a flowchart depicting another embodiment of a method of controlling steering of a propulsion device on a marine vessel.

FIG. 5 depicts another embodiment of a method 40 of operating a steering control system 10 which controls a resistance device 26 to implement endstop actuation based on one or more of a position, velocity, and/or acceleration of the steering wheel 12. In the embodiment, rotational position of the steering wheel 12 is received at step 72, and the controller 20 executes instructions to determine whether the rotational position of the steering wheel 12 is within a predetermined distance of one or the other endstops. For example, the predetermined distance may be far enough away from the endstops that the endstop can be effectuated even at high velocities and accelerations of the steering wheel 12. The predetermined amount of time may be established based on the mechanical delay between sending the command from the controller 20 and the actuation of that command by the resistance device. If the steering wheel 12 is not within the predetermined distance of either endstop, then the controller returns to step 72 to monitor the rotational position of the steering wheel 12.

Conversely, if the steering wheel 12 is within the predetermined distance of one or the other endstops, then the controller 20 may execute instructions at step 76 to determine whether the steering wheel 12 is at or past the endstop. If so, then the controller 20 executes step 74 to immediately instruct the resistance device 26 to apply the maximum resistance force to resist movements past the endstop, or at least minimize as much as possible any such movement past the endstop. Assuming that the steering wheel 12 has not yet reached the endstop, then the controller 20 executes instructions at step 78 to determine the rotational velocity of the steering wheel 12. The rotational acceleration may also be calculated at step 80, and at step 82 the controller 20 may execute instructions to determine whether the steering wheel will reach the endstop within a predetermined amount of time. If not, then the controller returns to step 72 to monitor the rotational position of the steering wheel 12. Conversely, if the controller 20 determines based on the velocity and acceleration that the endstop is about to be reached, then the controller 20 may instruct the resistance device 26 to apply the maximum resistance force to effectuate the endstop.

In one embodiment, the resistance force for implementing the endstop may be determined using one or more lookup tables, such as one wheel position versus wheel velocity lookup table and one wheel position versus wheel acceleration lookup table. Both tables would have braking force, or resistance force, as the output. The velocity table would apply braking earlier, for example at 95% if velocity indicates that the endstop is approaching quickly—not waiting until the base start of braking at 98%. The acceleration table could work in a similar fashion. If the wheel is at 90% position and the user quickly accelerates the wheel toward the endstop, again it could respond by adding braking force before reaching the baseline + velocity braking force.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. A drive-by-wire control system for steering a propulsion device on a marine vessel, the drive-by-wire system comprising:

a steering wheel that is manually rotatable;

a steering actuator that causes the propulsion device to steer based on rotation of the steering wheel;

a resistance device that applies a resistance force against rotation of the steering wheel; and a controller that controls the resistance device based on at least one sensed condition of the system, wherein the controller is configured to detect a fault condition, and to control the resistance device to vary the resistance force on the steering wheel in pulses upon detecting the fault condition.

2. A drive-by-wire control system for steering a propulsion device on a marine vessel, the drive-by-wire system comprising:

a steering wheel that is manually rotatable;

a steering actuator that causes the propulsion device to steer based on rotation of the steering wheel;

a resistance device that applies a resistance force against rotation of the steering wheel; and a controller that controls the resistance device to vary the resistance force based on a correlation between at least one of a speed of travel of the marine vessel and an engine speed and at least one of a rotational position of the steering wheel, a rotational velocity of the steering wheel, and a rotational acceleration of the steering wheel.

3. The drive-by-wire control system according to claim 2, further comprising a memory containing a lookup table correlating thee speed of travel of the marine vessel or the engine speed and the at least one of the rotational position of the steering wheel, the rotational velocity of the steering wheel, and the rotational acceleration of the steering wheel to an amount of resistance force.

4. The drive-by-wire control system according to claim 2, wherein the steering actuator comprises a hydraulic steering actuator and wherein the sensed condition further includes one of the hydraulic pressure and the current draw associated with the hydraulic steering actuator.

5. The drive-by-wire control system according to claim 4, wherein the propulsion device is one of a plurality of propulsion devices and wherein the controller is configured to calculate a net hydraulic pressure for the steering actuators associated with the plurality of propulsion devices, and wherein the sensed condition comprises the net hydraulic pressure.

6. The system of claim 4, further comprising a memory containing a lookup table correlating the hydraulic pressure or the current draw and a rotational velocity of the steering wheel to the amount of resistance force.

7. The drive-by-wire control system according to claim 2, wherein the sensed condition of the system further includes a fault condition, and wherein the controller is configured to control the resistance device to vary the resistance force on the steering wheel in pulses upon sensing the fault condition.

8. The system of claim 2, wherein the controller is configured to control the resistance device based on a sum of at least a first resistance amount and a second resistance amount, wherein the first resistance amount is determined based on the speed of travel of the marine vessel or the engine speed and the rotational position of the steering wheel, and the second resistance amount is determined based on the speed of travel of the marine vessel or the engine speed and the rotational velocity of the steering wheel.

9. A method of operating a drive-by-wire control system for steering a propulsion device on a marine vessel, the method comprising:

receiving a rotational position of a manually rotatable steering wheel;

causing, with a steering actuator, the propulsion device to steer the marine vessel based on the rotational position of the steering wheel;

sensing a speed of travel of the marine vessel or sensing an engine speed;

determining an amount of resistance force by accessing a lookup table correlating the speed of travel or the engine speed to the amount of resistance force; and controlling the resistance device to apply at least the amount of resistance force against rotation of the steering wheel.

10. The method of claim 9, further comprising:

sensing the rotational position of the steering wheel;

wherein the lookup table correlates the speed of travel or the engine speed and the rotational position of the steering wheel to the amount of resistance force.

11. The method of claim 9, further comprising:

sensing the rotational position of the steering wheel over time;

determining at least one of a rotational velocity of the steering wheel and a rotational acceleration of the steering wheel;

accessing a lookup table correlating the rotational velocity or the rate of rotational acceleration to an additional amount of resistance force; and controlling the resistance device based on a sum of the amount of resistance force and the additional amount of resistance force.

12. The method of claim 9, further comprising:

sensing a hydraulic pressure or a current draw associated with the steering actuator; accessing a lookup table correlating the hydraulic pressure or the current draw to an additional amount of resistance force; and controlling the resistance device based on a sum of the amount of resistance force and the additional amount of resistance force.

13. The method of claim 12, further comprising:

sensing a hydraulic pressure or a current draw associated with two or more steering actuators on the marine vessel;

determining a net hydraulic pressure or current draw; accessing the lookup table correlating the net hydraulic pressure or the current draw to the additional amount of resistance force.

14. The method of claim 9, further comprising:

detecting a fault condition associated with at least one of the steering actuator or the propulsion device; and wherein controlling the resistance device includes pulsing the resistance force on the steering wheel upon detecting the fault condition.

15. The method of claim 10, further comprising:

sensing the rotational position of the steering wheel;

determining at least one of a rotational velocity of the steering wheel and a rotational acceleration of the steering wheel;

accessing a lookup table correlating correlates the speed of travel or the engine speed and the rotational velocity or the rate of rotational acceleration to an additional amount of resistance force; and controlling the resistance device based on a sum of the amount of resistance force and the additional amount of resistance force.

16. A method of operating a drive-by-wire control system for steering a propulsion device on a marine vessel, the method comprising:

sensing a rotational position of a manually rotatable steering wheel;

controlling a steering actuator based on the rotational position of the steering wheel to control a direction of the marine vessel;

sensing a hydraulic pressure or a current draw associated with the steering actuator;

determining a rotational velocity of the steering wheel;

determining an amount of resistance force based on a correlation between the hydraulic pressure or the current draw of the steering actuator and the rotational velocity of the steering wheel; and controlling the resistance device to apply at least the amount of resistance force against rotation of the steering wheel.

17. The method of claim 16, wherein determining the amount of resistance includes accessing a lookup table correlating the hydraulic pressure or the current draw and the rotational velocity of the steering wheel to the amount of resistance force.

18. The method of claim 16, further comprising:

determining an additional resistance force based on a speed of travel of the marine vessel or an engine speed and the rotational position of the steering wheel; and controlling the resistance device based on a sum of the amount of resistance force and the additional amount of resistance force.

* * * * *